US007905375B2

(12) United States Patent
Schneider et al.

(10) Patent No.: US 7,905,375 B2
(45) Date of Patent: Mar. 15, 2011

(54) DISPENSING DEVICE ARRANGED TO REDUCE THE RISK OF STRAIN AND INJURY DURING USE

(75) Inventors: Mark C Schneider, Moorestown, NJ (US); Joseph B Hanni, Cherry Hill, NJ (US)

(73) Assignee: Albion Engineering Company, Moorestown, NJ (US)

( * ) Notice: Subject to any disclaimer, the term of this patent is extended or adjusted under 35 U.S.C. 154(b) by 369 days.

(21) Appl. No.: 12/183,481

(22) Filed: Jul. 31, 2008

(65) Prior Publication Data

US 2010/0025436 A1 Feb. 4, 2010

(51) Int. Cl.
*B67D 7/60* (2010.01)

(52) U.S. Cl. ..... 222/389; 222/1; 222/137; 222/326; 222/327; 222/334

(58) Field of Classification Search ..... 222/325–327, 222/334, 145.1, 145.6, 137, 145.5, 256, 262, 222/386.5, 386, 1, 389, 394
See application file for complete search history.

(56) References Cited

U.S. PATENT DOCUMENTS

| | | | | |
|---|---|---|---|---|
| 3,980,209 | A * | 9/1976 | Collar | 222/323 |
| 4,067,479 | A * | 1/1978 | Moline | 222/94 |
| 4,676,410 | A * | 6/1987 | von Flue | 222/327 |
| 4,765,509 | A * | 8/1988 | Eisenhut et al. | 222/61 |
| 5,020,693 | A * | 6/1991 | Ernst et al. | 222/137 |
| 5,104,005 | A | 4/1992 | Schneider | |
| 5,184,758 | A * | 2/1993 | Keller | 222/137 |
| 5,224,629 | A | 7/1993 | Hsich | |
| 5,390,831 | A | 2/1995 | Schneider | |
| 5,441,175 | A * | 8/1995 | Jacobsen et al. | 222/137 |
| 5,816,445 | A * | 10/1998 | Gardos et al. | 222/1 |
| 5,823,403 | A | 10/1998 | Schneider | |
| 6,016,937 | A * | 1/2000 | Clay | 222/330 |
| 6,039,223 | A | 3/2000 | Damask | |
| 6,135,328 | A * | 10/2000 | Schneider et al. | 222/389 |
| 6,382,466 | B1 | 5/2002 | Schneider | |
| 2004/0134937 | A1 | 7/2004 | Beckwith | |
| 2004/0226969 | A1 | 11/2004 | Shew | |

FOREIGN PATENT DOCUMENTS

| | | |
|---|---|---|
| GE | 842256 | 6/1952 |

OTHER PUBLICATIONS

International Search Report re International Application No. PCT/US2009/049089.

* cited by examiner

*Primary Examiner* — Frederick C. Nicolas
(74) *Attorney, Agent, or Firm* — Caesar, Rivise, Bernstein, Cohen & Pokotilow, Ltd.

(57) ABSTRACT

A device for dispensing flowable materials to low locations without the user being required to bend over or kneel down during dispensing provides relief from back strain or other injuries. The device includes a cylinder having a piston mounted therein which reciprocates between forward ejecting and return directions. A driven rod, connected to the piston, extends through a front wall of the cylinder. Upon actuation, a trigger mechanism supplies a pressure medium within the cylinder for displacing the piston in the forward ejecting direction to dispense flowable material from the dispensing device. The trigger mechanism is oriented to enable the user to hold the dispensing device like a suitcase and is spaced a sufficient distance from where the flowable material is dispensed to enable a user to remain standing erect while dispensing to low areas such as where a floor and wall meet.

17 Claims, 3 Drawing Sheets

FIG. 3
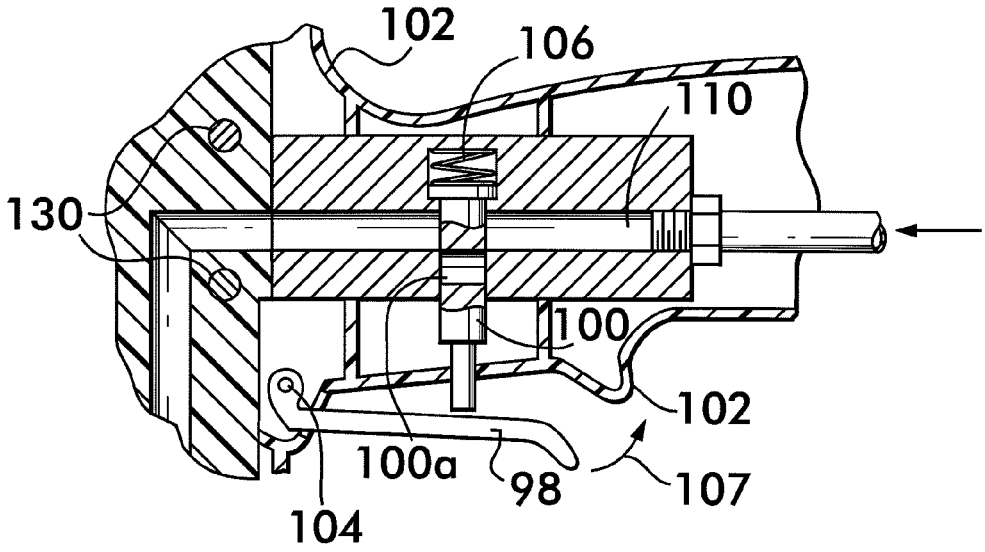
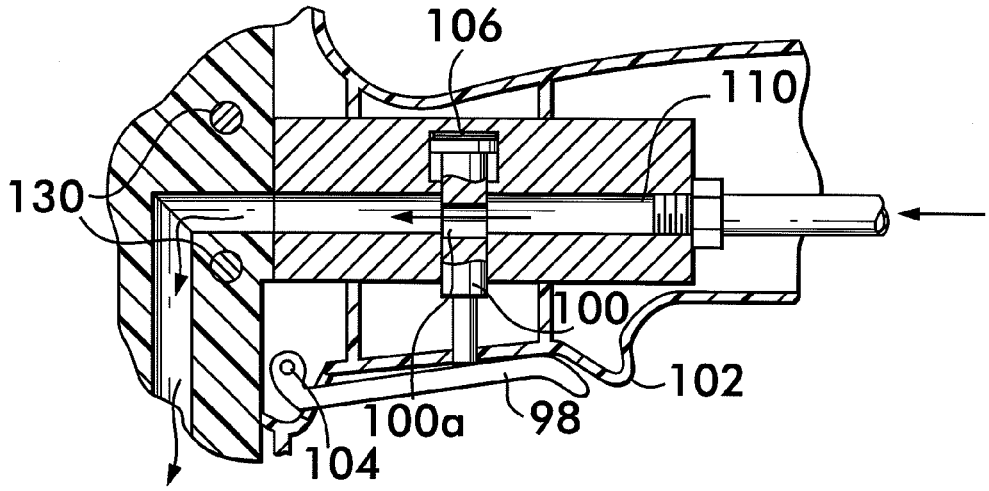
FIG. 4

DISPENSING DEVICE ARRANGED TO REDUCE THE RISK OF STRAIN AND INJURY DURING USE

BACKGROUND OF THE INVENTION

The present invention relates to dispensing devices. More particularly, the present invention relates to a dispensing device that enables a user to dispense flowable material to low locations, such as where a floor meets a wall, without requiring the user to bend over, kneel down or squat during dispensing, thus reducing the risk of strain or other back injury. The present invention also reduces the need for the user to contort the arm, wrist, hand, and other body parts, where the low location to which flowable material is to be dispensed is difficult to access.

Commercially available devices for dispensing flowable compositions such as caulking materials, grease, automotive windshield sealant, reactive resins, and the like, generally consist of a rearward driving section and a forward section in the form of a carriage assembly for housing a composition to be dispensed. The rearward drive section includes a cylinder having a front end wall, a rear end wall, and a cylindrically-shaped sidewall. A piston disposed within the cylinder divides the cylinder into a front portion and a rear portion. At least one driven rod is connected to the piston and extends through the front end wall of the cylinder. The driven rod terminates in an ejector ram. The piston, its driven rod and ejector ram, are driven in an ejecting direction in response to pressure provided within the rear portion of the cylinder to dispense flowable material stored in the forward section of the dispensing device. The flowable material may be stored in bulk or in cartridge form, e.g., hard cartridges or sausage-type cartridges. As the driven rod and ejector ram are driven in the ejecting direction, material from one or more cartridges is ejected from the dispenser to the area of application.

Introduction of pressure behind the piston is controlled by actuation of a trigger mechanism on the dispensing device. On commercially available dispensing devices, the trigger mechanism is located beneath the cylinder during dispensing. The trigger mechanism includes a handle and an actuable trigger, both of which extend downwardly in a direction generally perpendicular to the length of the hollow cylinder. Such commercially available dispensing devices have several drawbacks, especially when applying flowable material to low locations, such as along the perimeter of a room or a shower stall where the wall meets the floor. The main drawback is that due to the location and orientation of the trigger mechanism on such dispensing devices, it is usually necessary for the user to bend over, kneel down, or squat towards the floor to accurately apply the flowable materials to such low locations. Another drawback associated with the location and orientation of the trigger mechanism on commercially available dispensing devices is that the user may need to twist or contort his or her arm, wrist, hand, and other body part when using such a commercially available dispensing device to apply flowable material to low locations that are difficult to access. This can be an uncomfortable operation for many users, and may result in back strain or other injury. Because it is physically difficult for some users to dispense flowable materials to such low locations using a conventional dispensing device, the material may not be properly applied.

Therefore, what is needed is a dispenser that is arranged to facilitate the application of flowable materials to these low areas. The present invention fulfills these needs and provides other related advantages.

SUMMARY OF THE INVENTION

These and other objects of this invention are achieved by providing a device for dispensing flowable materials to low locations without the user being required to bend over or kneel down during dispensing which provides relief from back strain or other injuries. The device includes a cylinder having a piston mounted therein which reciprocates between forward ejecting and return directions. A driven rod, connected to the piston, extends through a front wall of the cylinder. Upon actuation, a trigger mechanism supplies a pressure medium within the cylinder for displacing the piston in the forward ejecting direction to dispense flowable material from the dispensing device. The trigger mechanism is oriented to enable the user to hold the dispensing device like a suitcase and is spaced a sufficient distance from where the flowable material is dispensed to enable a user to remain standing erect while dispensing to low areas such as where a floor and wall meet. Moreover, the trigger mechanism is positioned and oriented to allow a more comfortable dispensing position when such low locations are in areas which are difficult to access.

DESCRIPTION OF THE DRAWINGS

The objects and many attendant features of this invention will become readily appreciated as the same becomes better understood by reference to the following detailed description when considered in connection with the accompanying drawings wherein:

FIG. 3 is an enlarged, sectional view of a portion of the dispensing device of the present invention illustrating the trigger mechanism in the unactuated position; and, FIG. 4 is an enlarged, sectional view of a portion of the dispensing device of the present invention illustrating the trigger mechanism in the actuated position.

DESCRIPTION OF THE PREFERRED EMBODIMENT

Figure 1:
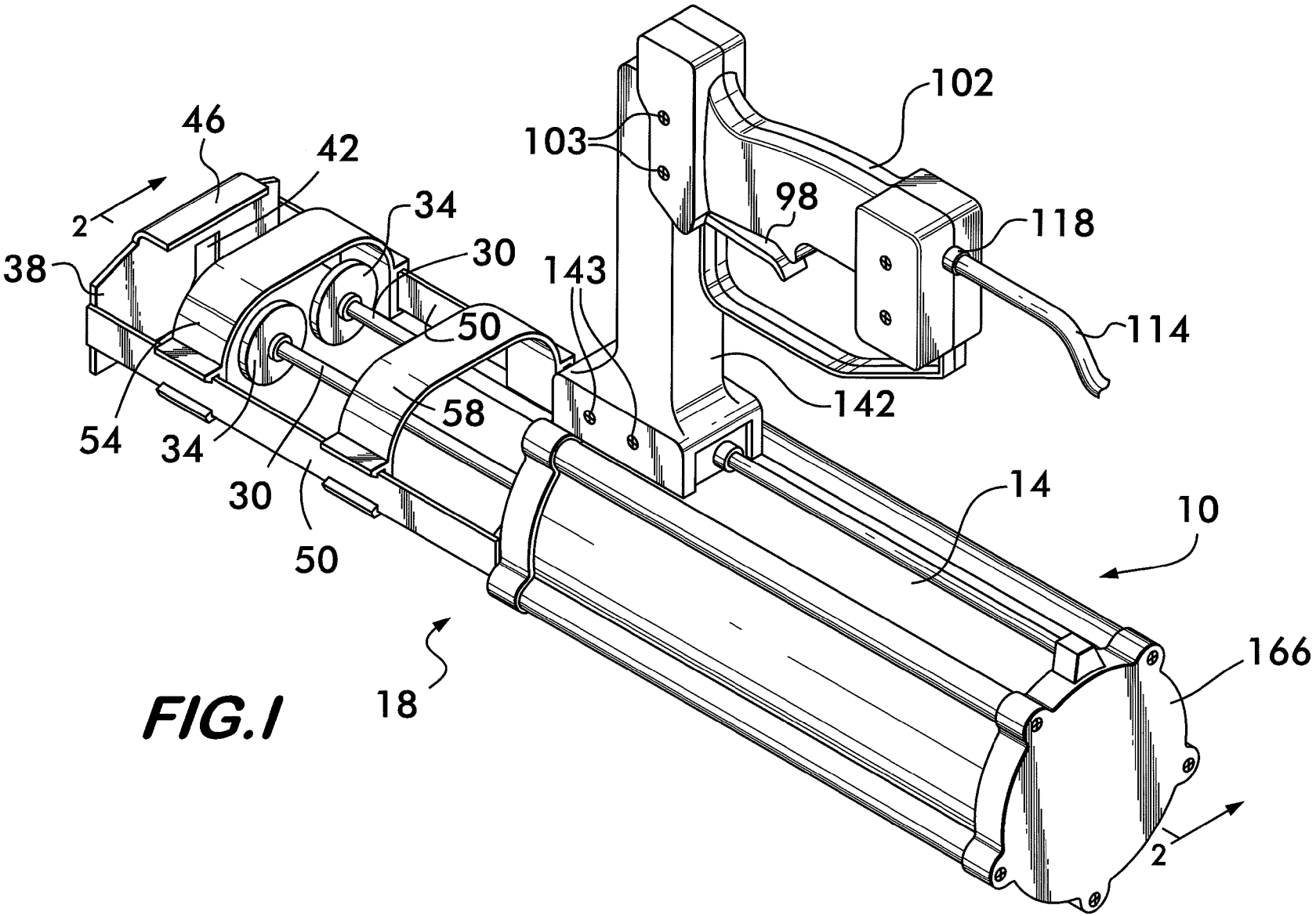
FIG. 1 is an isometric view of a preferred embodiment of the dispensing device of the present invention.
Figure 2:
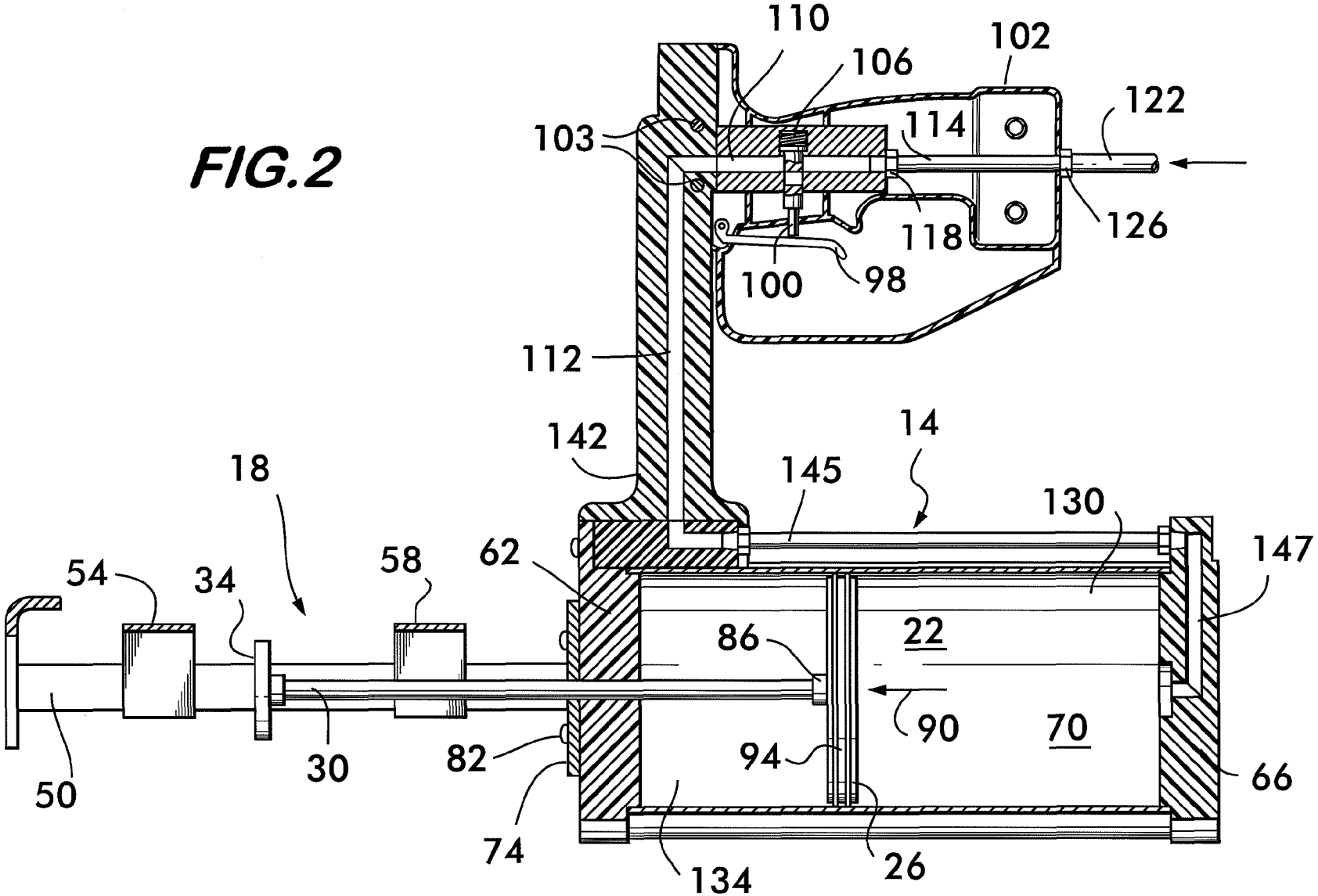
FIG. 2 is an enlarged, sectional view taken along line 2-2 of FIG. 1.

Referring now to the drawings, a device for dispensing materials in accordance with the present invention is shown generally at 10 in FIGS. 1 and 2. The dispensing device 10 includes a rearward driving section 14 and a forward section in the form of a dual component carriage assembly 18 of conventional design for housing a composition to be dispensed. The rearward driving section 14 includes an air cylinder assembly 22 (FIG. 2) within which there is positioned a piston 26. As best shown in FIGS. 1 and 2, the piston 26 operates two driven rods 30 which terminate in ejector rams 34.

Referring now to FIG. 1, the dual component carriage assembly 18 houses a plurality, e.g., two, cartridge assemblies (not shown) containing components to be dispensed. It should be understood that the carriage assembly 18 can be of any desired construction for housing a composition to be dispensed and does not constitute a limitation on the present invention. For example, although the embodiment chosen for illustration herein includes the composition in a dual disposable and replaceable hard cartridges or containers (not shown), the dispensing devices incorporating this invention can also include a fixed and permanent container for receiving material to be dispensed that initially is packaged in bulk form, or for receiving material to be dispensed from a flexible, sausage-type cartridge. Moreover, all of these latter-mentioned options (i.e., hard cartridge, bulk form and sausage-type cartridge) can be employed in single component dispensing devices as well as in dual component dispensing devices as shown in the drawings herein.

The hard cartridges that are used in conjunction with such dispensing devices are of a standard size and configuration and comprise a tubular cylindrical body portion containing material to be dispensed, a cup-shaped movable plunger at the rearward end of the body portion, and dispensing nozzles located at the forward end of the cartridges. The moveable plunger provides means for the dispensing device to apply dispensing pressure to the material within the cartridges. When the cartridges are appropriately registered within the carriage assembly 18, each moveable plunger is arranged to be moved in a forward ejecting direction towards the nozzles to expel material from the body portion of the cartridges.

Referring again to FIG. 1, the carriage assembly 18 includes at its forward end a forward support bracket 38 having one or more openings 42 positioned thereon for passage of the dispensing nozzles of the cartridges therethrough. The forward support bracket 38 also includes an upper stirrup 46 to assist in positioning and retaining the cartridges within the carriage assembly 18. Optionally, a lower stirrup (not shown) may be included for added support. The forward support bracket 38 is joined to a pair of elongate support members 50 by any suitable means, e.g., welding. Structures 54 and 58 are disposed between the support members 50 to add rigidity to the elongated support members 50, and also to locate and retain the cartridge assemblies (not shown), e.g., hard cartridges, within the carriage assembly 18.

Referring now to FIG. 2, there is shown in section the internal components of the dispensing device 10. The air cylinder assembly 22 includes a front bulk head 62, a rear bulk head 66 and a cylindrical side wall 70. The carriage assembly 18 is secured to the outer surface of the front bulk head 62 by a spacer 74 and appropriate fastening hardware, e.g., retaining screws 82. As previously mentioned, disposed within the air cylinder assembly 22 is a piston 26 which operates two driven rods 30 that terminate in ejector rams 34. At the end opposite the ejector rams 34, each driven rod 30 is provided with hardware, e.g., a securing nut 86, to enable securement of the driven rod 30 to the piston 26. Each driven rod 30 chosen for illustration herein is a smooth-surfaced rod of a generally circular cross-section, and each rod 30 extends through a generally circular-shaped opening (not shown) located in the forward bulkhead 62. The piston 26 is arranged for movement within the air cylinder assembly 22 in a forward ejecting direction as illustrated by arrow 90. When moved in this direction, the driven rods 30 move forward to dispense the materials from the cartridges (not shown) through the ejection nozzles. The piston 26 is also arranged to be moved in the opposite direction to a fully returned position wherein the piston 26 engages with the rear bulkhead 66 to enable the removal of the previously emptied cartridges and the insertion of fresh cartridges.

As best shown in FIGS. 1 and 2, the piston 26 is circular in shape and includes an associated seal 94 of conventional design, e.g., an o-ring, a leather seal, metal ring or glide ring, located in a land formed on the outer circumference of the piston 26. The seal 94 prevents air from passing between the piston 26 and the cylindrical wall 70 during movement of the piston 26 in the forward ejecting direction and in the opposite, returning direction.

Referring now to FIGS. 2, 3 and 4, it should be understood that the piston 26 is driven in the forward ejecting direction 90 by actuation of a trigger 98 in a direction toward a carrying handle 102, as indicated by arrow 107 in FIG. 3. The carrying handle 102 is positioned centrally over the dispensing device 10 for balance when dispensing from the dispensing device 10. As best shown in FIGS. 1 and 2, the carrying handle 102 is positioned above the driving section 14 and carriage assembly 18 and is separated from the rearward driving section 14 and carriage assembly 18 by an elongated extension piece 142. The carrying handle 102 is secured to the extension piece by appropriate fastening hardware, e.g., a plurality of retaining screws 103.

The extension piece 142 is secured in proximity to the front bulkhead 62 by appropriate fastening hardware, e.g., a plurality of retaining screws 143, and extends upwardly from the air cylinder assembly 22. In this manner, during use, the extension piece 142 of the dispensing device 10 enables a user to dispense flowable material to low locations, such as where a floor meets a wall, without requiring the user to bend over, kneel down or squat during dispensing, thus reducing the risk of strain or other back injury. Due to the extension piece and orientation of the trigger 98 and carrying handle 102, the dispensing device 10 may be held like a suitcase.

By removal of the retaining screws 143, the extension piece 142 may be disconnected from the cylinder assembly 22; and, by removal of the retaining screws 103, the carrying handle 102 may be separated from the extension piece 142. In this manner, the extension piece 142 may be easily eliminated and the carrying handle 102 may be connected directly to the air cylinder assembly 22 in proximity to the front bulk head 62, to enable quick and easy conversion to a dispensing device similar to those that are currently commercially available.

Trigger 98 is pivotally mounted to the carrying handle 102 by any suitable means, e.g., a pivot pin 104 passing through the carrying handle 102. It should be understood that the pivot pin 104 could be replaced with any other desired pivot support. The trigger 98 is in contact with a bearing 100 which biases the trigger 98 away from the carrying handle 102 by means of a conventional compression spring 106. The bearing 100 includes a through opening **100*a*. Disposed within the carrying handle 102 is an internal air passageway 110 which allows the passage of pressurized air from an external air pressure supply (not shown) into the dispensing gun 10. As best shown in FIG. 2, the air passageway 110 extends through the carrying handle 102 and communicates with an air passageway 112 extending through the extension piece 142 which, in turn, communicates with an air tube 145, which communicates with an air passageway 147 located in the rear bulk head 66. The air passageway 147 opens into the cylinder assembly 22. The air passageway 110 is connected to an appropriate air line 114 by means of a suitable coupling 118. In turn, the air line 114 may be attached to an appropriate hose 122 by means of a suitable coupling 126. The air hose 122** may be connected to the air pressure supply (not shown).

As best shown in FIG. 3, when not actuated, the compression spring 106 biases the trigger 98 away from the carrying handle 102 and the through opening **100*a* of the bearing 100 is out of the path of the air passageway 110 and the bearing blocks passage of pressurized air through the air passageway 110. In operation, when the trigger 98 is depressed, the compression spring 106 is compressed and the through opening 100*a* of the bearing 100 aligns with the internal air passageway 110 to permit the passage of pressurized gas, e.g., air, through the air passageways 110 112, 145, and 147 and into the cylinder assembly 22 through the rear bulk head 66 to drive the piston 26 in the forward direction as indicated by the arrow 90. Pressurized air enters a rear portion 130 of the air cylinder assembly 22 between the piston 26 and the rear bulkhead 66. Parenthetically, the cylinder assembly 22 also includes a front portion 134 defined as being that portion of the cylinder assembly 22 between the piston 26 and the front bulkhead 62. In this manner, air pressure within the rear portion 130 of the cylinder assembly 22 forces the piston 26 to travel in the forward direction indicated by the arrow 90. The driven rods 30, operating through the ejector rams 34, cause the material to be extruded from the cartridges (not shown) and ejected from the caulking gun. By providing distance between the handle 102 and the rearward driving section 14, the extension piece 142** enables a user to dispense flowable material to low locations without bending over or kneeling down, thus reducing strain or other back injury.

It should be understood that although the dispensing device described herein utilizes a pneumatic source, i.e., pressurized air, for dispensing flowable material therefrom, the dispensing device could be of any desired construction, and such use of pressurized air or another pneumatic source does not constitute a limitation on the present invention. For example, the dispensing device of the present invention could be a battery-powered cordless dispensing device or, alternatively, a manually-actuated dispensing device.

The device of the present invention has been described in respect to the particular embodiment thereof set forth in the specification and as illustrated in the drawings. As a result of such disclosure, other variations and modifications may become apparent to those skilled in the art and therefore, no limitation as to the scope of the invention is intended by the specific embodiments disclosed but the scope of the invention is to be interpreted in view of the appended claims.

Having described our invention, we claim:

1. A device to facilitate the dispensing of flowable material to low areas, said device comprising:

a. a hollow cylinder having a front end wall and a rear end wall spaced apart in the axial direction of the cylinder;

b. at least one piston displaceably mounted within the cylinder and adapted to reciprocate between a forward ejecting direction and a return direction;

c. at least one driven rod connected to said piston, said driven rod extending through the front end wall of said cylinder;

d. a trigger mechanism including a handle and an actuatable trigger which, upon actuation, supplies a pressure medium through a conduit to the rear portion of the cylinder for slidably displacing the piston in the forward ejecting direction for dispensing flowable material; and, e. an elongated extension piece having distal and proximal ends, the extension piece being secured at its distal end to said hollow cylinder, said extension piece extending upwardly above the hollow cylinder to said proximal end when said distal end is secured to said hollow cylinder, said trigger mechanism be secured to said extension piece adjacent said proximal end at a location spaced upwardly from the hollow cylinder when the device is being used to dispense the flowable material.

2. The device of claim 1, wherein the handle of the trigger mechanism is oriented generally parallel to the hollow cylinder.

3. The device of claim 1, wherein said at least one driven rod comprises two driven rods each extending through said front end wall, each driven rod terminating in an ejector ram.

4. The device of claim 2, further comprising a carriage means carried by said front end wall, said carriage means arranged for the exchangeable holding of a pair of cylindrically shaped cartridges provided with dispensing plungers, said ejector rams being provided for driving forward the plungers in an axial direction to dispense a substance from each said cartridge.

5. The device of claim 3, wherein said pressure source is external to said device and detachably connected thereto.

6. The device of claim 4, wherein said pressure source is a source of air pressure.

7. The device of claim 5, wherein said device is arranged for dispensing high viscosity compositions.

8. The device of claim 1, wherein said handle includes an internal passageway for the passage of said pressure medium.

9. The device of claim 8, wherein the actuatable trigger is biased away from the handle by a bearing and a spring.

10. The device of claim 9, wherein the bearing includes an opening therethrough and upon actuation of the trigger, the opening aligns with the internal passageway to permit pressurized air to travel through the internal passageway.

11. The device of claim 2, wherein the actuatable trigger normally is biased away from the handle in a direction toward said hollow cylinder, said trigger being pivotally mounted for movement away from said hollow cylinder to dispense the flowable material.

12. A method of dispensing flowable material to low areas including the steps of:

a. providing a device including:

a hollow cylinder having a front end wall and a rear end wall spaced apart in the axial direction of the cylinder;

at least one piston displaceably mounted within the cylinder and adapted to reciprocate between a forward ejecting direction and a return direction;

at least one driven rod connected to said piston, said driven rod extending through the front end wall of said cylinder;

a trigger mechanism including a handle and an actuatable trigger which, upon actuation, supplies a pressure medium through a conduit to the rear portion of the cylinder for slidably displacing the piston in the forward ejecting direction for dispensing flowable material; and an elongated extension piece having distal and proximal ends, the extension piece being secured at its distal end to said hollow cylinder, said extension piece extending upwardly above the hollow cylinder to said proximal end, said trigger mechanism be secured to said extension piece adjacent said proximal end at a location spaced upwardly from the hollow cylinder when the device is being used to dispense the flowable material;

b. engaging said device by said handle with the hollow cylinder extending below said handle in a position for dispensing the flowable material; and c. actuating said trigger mechanism for dispensing said flowable material.

13. The method of claim 12, including the step of actuating said trigger mechanism for dispensing said flowable material to low locations below said handle.

14. The method of claim 12, wherein the handle of the trigger mechanism is oriented generally parallel to the hollow cylinder, wherein the step of actuating said trigger mechanism is carried out by compressing the trigger toward the handle in a direction away from the hollow cylinder.

15. A method of converting a device including a trigger mechanism spaced vertically upward from a hollow cylinder of the device to dispense flowable material in low areas to a device wherein the vertical spacing between the trigger mechanism and the hollow cylinder is eliminated, said method including the steps of:

a. providing a device including:

a hollow cylinder having a front end wall and a rear end wall spaced apart in the axial direction of the cylinder;

at least one piston displaceably mounted within the cylinder and adapted to reciprocate between a forward ejecting direction and a return direction;

at least one driven rod connected to said piston, said driven rod extending through the front end wall of said cylinder;

a trigger mechanism including a handle and an actuatable trigger which, upon actuation, supplies a pressure medium through a conduit to the rear portion of the cylinder for slidably displacing the piston in the forward ejecting direction for dispensing the flowable material; and an elongated extension piece having distal and proximal ends, the extension piece being secured at its distal end to said hollow cylinder, said extension piece extending upwardly above the hollow cylinder to said proximal end, said trigger mechanism be secured to said extension piece adjacent said proximal end at a location spaced upwardly from the hollow cylinder when the device is being used to dispense the flowable material in low areas;

b. removing said trigger mechanism from said elongated extension piece;

c. removing the elongated extension from said hollow cylinder by separating the distal end of the extension means from said hollow cylinder; and d. attaching said trigger mechanism to the location of the hollow cylinder at which the distal end of said extension piece previously was secured.

16. A method of converting a device including a trigger mechanism closely positioned to, and attached to a hollow cylinder for dispensing flowable material from the device by actuation of the trigger mechanism, to a device wherein the trigger mechanism is spaced vertically upward from the hollow cylinder of the device to dispense the flowable material in low areas, said method including the steps of:

a. providing a device including:

a hollow cylinder having a front end wall and a rear end wall spaced apart in the axial direction of the cylinder;

at least one piston displaceably mounted within the cylinder and adapted to reciprocate between a forward ejecting direction and a return direction;

at least one driven rod connected to said piston, said driven rod extending through the front end wall of said cylinder;

a trigger mechanism including a handle and an actuatable trigger which, upon actuation, supplies a pressure medium through a conduit to the rear portion of the cylinder for slidably displacing the piston in the forward ejecting direction for dispensing the flowable material, said trigger mechanism being closely positioned to and attached to said hollow cylinder;

b. disconnecting the trigger mechanism from its attachment to said hollow cylinder;

c. providing an elongated extension piece having distal and proximal ends;

d. attaching the extension piece at its distal end to said hollow cylinder, said extension piece extending upwardly above the hollow cylinder to said proximal end; and e. attaching said trigger mechanism to said extension piece adjacent said proximal end at a location spaced upwardly from the hollow cylinder to adapt the device for dispensing the flowable material in low areas.

17. A convertible device for dispensing flowable material to, said device comprising:

a. a hollow cylinder having a front end wall and a rear end wall spaced apart in the axial direction of the cylinder;

b. at least one piston displaceably mounted within the cylinder and adapted to reciprocate between a forward ejecting direction and a return direction;

c. at least one driven rod connected to said piston, said driven rod extending through the front end wall of said cylinder;

d. a trigger mechanism including a handle and an actuatable trigger which, upon actuation, supplies a pressure medium through a conduit to the rear portion of the cylinder for slidably displacing the piston in the forward ejecting direction for dispensing flowable material; and, e. an elongated extension piece having distal and proximal ends, the extension piece being removably securable at its distal end to said hollow cylinder, said trigger mechanism being removably securable to said extension piece adjacent said proximal end and also being removably securable to the hollow cylinder in place of said distal end of said extension piece, whereby said trigger mechanism can be removably secured to said hollow cylinder in place of the distal end of the elongated extension piece or alternatively can be removably secured adjacent the proximal end of said extension piece with the distal end of said extension piece being removably secured to said hollow cylinder.

* * * * *